United States Patent [19]

Koyama et al.

[11] Patent Number: 5,072,067

[45] Date of Patent: Dec. 10, 1991

[54] LUBRICATING OIL COMPOSITION

[75] Inventors: Saburo Koyama; Seiichi Shido; Kenji Onodera; Shigeo Hara, all of Ichihara, Japan

[73] Assignee: Idemitsu Kosan Co. Ltd., Tokyo, Japan

[21] Appl. No.: 430,249

[22] Filed: Nov. 2, 1989

[30] Foreign Application Priority Data

Nov. 15, 1988 [JP] Japan ..... 63-286868
Apr. 24, 1989 [JP] Japan ..... 1-101557

[51] Int. Cl.[5] ..... C07C 7/20

[52] U.S. Cl. ..... 585/3; 252/49.3; 252/49.5; 585/12; 585/16; 585/17; 585/18

[58] Field of Search ..... 585/12, 16, 17, 18, 585/10, 13, 3; 252/49.3

[56] References Cited

U.S. PATENT DOCUMENTS 3,288,715 11/1966 Owens ..... 252/49.5
3,854,893 12/1974 Rossi ..... 585/13
4,319,064 3/1982 Heckelsberg et al. ..... 585/16
4,386,229 5/1983 Heckelsberg et al. ..... 585/392
4,395,578 7/1983 Larkin ..... 585/12
4,413,156 11/1983 Watts, Jr. et al. ..... 585/18
4,434,309 2/1984 Larkin et al. ..... 585/10
4,827,073 5/1989 Wu ..... 585/18

OTHER PUBLICATIONS

Aldrich Chemical catalog (1988) p. 448.

*Primary Examiner*—Asok Pal
*Attorney, Agent, or Firm*—Antonelli, Terry, Stout & Kraus

[57] ABSTRACT

Disclosed are a lubricating oil composition for plastic working and a lubricating oil composition for cutting and grinding which comprises a straight chain olefin having 6 to 40 carbon atoms. This lubricating oil composition for plastic working or a lubricating oil composition for cutting and grinding provides excellent workability and can give the material worked an excellent finish.

6 Claims, No Drawings

LUBRICATING OIL COMPOSITION

BACKGROUND OF THE INVENTION

This invention relates to a lubricating oil composition that is specifically useful for plastic working or for cutting and grinding of metals. More particularly, this invention relates to a lubricating oil composition comprising a specific linear olefin or straight chain olefin, which can finely finish the surface of a product when plastic working such as rolling, drawing, blanking, dieing out, and cold forging or in cutting and grinding.

When lubricating oil composition is used, not only workability can be improved, but also the rust resistance and wear resistance of the working tools and machinery will substantially improve resulting in longer life of the working tools.

DESCRIPTION OF THE RELATED ARTS

Until now, the workability of an oil composition for plastic working has been maintained by blending an oiliness agent or an extreme pressure agent such as alcohol, aliphatic ester, or aliphatic acid to a mineral oil or a synthetic saturated hydrocarbon oil. However, in this kind of conventional oil composition for plastic working, workability is insufficient so productivity cannot be enhanced. Furthermore, by adding the above oiliness agent or extreme pressure agent, there are various disadvantages so that such agent makes degreasing or rust prevention of the worked portions sufficient.

A lubricating oil composition in which a fat and oil type oiliness agent or extreme pressure agent is added to a base oil such as a mineral oil or a synthetic oil has also been used until now for cutting and grinding. However, these conventional oil compositions have disadvantages related to surface finishing or surface detergence. Furthermore, in order to overcome these disadvantages, it has been necessary to add large amounts of oiliness agents, extreme pressure agents, etc. However, not only could the above disadvantages not be overcome, but the surface detergence or rust preventive property of the material to be worked were also extremely deteriorated. In addition, if the surface detergence is poor, it has to be washed with solvents such as Flon, trichlene, etc., so pollution due to the solvents becomes a serious problem.

On the other hand, it has been known that a straight chain olefin improves the characteristics of lubricating oil compositions for various machines (see Japanese Patent Application Laid-Open No. 15490/1984). Furthermore, it has been reported that the straight chain olefin itself shows a specific lubricating characteristic (Wear, 9 (1966) 160–168, and others).

However, each of the straight chain olefins is used as an additive for lubricating oils for generators, power machines, etc., and techniques in which this straight chain olefin is applied to plastic working including rolling, or cutting and grinding, are not known.

SUMMARY OF THE INVENTION

An object of the present invention is to provide a lubricating oil composition for achieving excellent workability when aluminum, steel, brass or other metals or alloys are subjected to plastic working.

Another object of the present invention is to provide a lubricating oil composition for plastic working that is capable of forming an excellent surface on the material to be worked or the product.

A further object of the present invention is to provide a lubricating oil composition for cutting and grinding working that is capable of forming an excellent surface state for the material to be worked or the product when cutting or grinding the above materials or alloys.

A still further object of the present invention is to provide a lubricating oil composition for cutting and grinding with excellent surface detergency, rust preventive property, wear resistance, etc., during cutting or grinding the above metals or alloys.

That is, the present invention relates to a lubricating oil composition for plastic working or cutting and grinding, which comprises a straight chain olefin having 6 to 40 carbon atoms.

DESCRIPTION OF THE PREFERRED EMBODIMENTS

A straight chain olefin (or a linear olefin) to be used in the present invention is as described above for those having 6 to 40 carbon atoms. Those having not more than 6 carbon atoms are not suitable because their flash points are low. In addition, those having more than 40 carbon atoms are not suitable because they are in a solid state, so it is difficult to use them, and yet mixing or dissolving with a base oil or other additives becomes difficult. Furthermore, those having more than 40 carbon atoms are not generally available. Among these straight chain olefins, a compound having one double bond in the molecule and having 6 to 30 carbon atoms is preferred, and in particular, an $\alpha$-olefin (e.g. n-$\alpha$-olefin) having 12 to 30 carbon atoms is most preferred.

Specific examples of these straight chain olefin may include 1-octene, 1-decene, 1-dodecene, 1-tetradecene, 1-hexadecene, 1-octadecene, 1-eicosene, or mixtures thereof. As these straight chain olefins, those which can be obtained by various methods may be used; for example, an ethylene oligomer obtained by polymerizing ethylene by a conventional method can be used.

In the present invention, the lubricating oil composition for plastic working may be constituted by the above straight chain olefin alone, but the straight chain olefin is preferably added in an amount of 0.5 to 99.5% by weight, more preferably 1 to 80% by weight, and most preferably 2 to 50% by weight based on the total amount of the lubricating oil composition.

On the other hand, the lubricating oil composition for cutting and grinding in the present invention may be formed by the above straight chain olefin alone as in the above lubricating oil composition for plastic working. However, in the lubricating oil composition for cutting and grinding, the preferred amount of the straight chain olefin is 0.5% by weight or more, particularly preferable is 0.5 to 80% by weight, and most preferable is 2 to 60% by weight based on the total amount of lubricating oil composition. In particular, in the case where the amount of straight chain olefin is 80% by weight or less, a remarkably improved wear resistance effect can be obtained. If the amount is less than 0.5% by weight, no improved effect in characteristics can be observed.

As the components constituting the lubricating oil composition of the present invention, there may be mentioned a base oil such as a mineral oil, synthetic oil, etc., or water, or mixtures thereof. As the above base oil, those having a kinematic viscosity at 40° C. of 0.5 to 500 cSt, particularly 1 to 50 cSt are generally preferable. Mineral oils are not particularly limited and various ones may be used. For example, there are distilled oils obtained by subjecting paraffin-based crude oils, intermediate-based crude oils or naphthene-based crude oils to atmospheric pressure distillation or subjecting residual oils of atmospheric pressure distillation to vacuum distillation, or purified oils obtained by subjecting the above oils to purification according to the conventional method. More specifically, there may be mentioned solvent purified oil, a hydrogenated purified oil, dewaxing treatment oil, clay treatment oil, etc. When the above straight chain olefin is added to these mineral oils, a lubricating oil composition having an improved oxidation resistance can be obtained.

As synthetic oils to be used in combination with the above linear olefins, there may be mentioned other olefins (for example, a branched olefin such as polybutene, or polypropylene), or a hydrogenated material of the above olefins etc. Particularly preferred are low molecular weight polybutenes and low molecular weight polypropylene, and most preferable are $\alpha$-olefin oligomers having 8 to 14 carbon atoms. When the above straight chain olefin is added to these synthetic oils, the resulting lubricating oil composition generates less smell during usage, improves the working environment and improves the detergency of the product's surface. In particular, a light synthetic oil in a lubricating oil composition to be used for precision cutting working is suitable as a base oil.

When water is used instead of a base oil, the lubricating oil composition becomes an emulsion in which the straight chain olefin is dispersed in the water or an emulsion in which water is dispersed in the straight chain olefin. These emulsions may be used in the present invention.

In the lubricating oil composition for plastic working or lubricating oil composition for cutting and grinding of the present invention, known oiliness agents or extreme pressure agents include various alcohols, aliphatic acids, esters, diesters, polyvalent esters, fats and oils, sulfurized fats and oils, sulfurized esters, sulfurized olefins, chlorinated paraffins, phosphate esters, amine salts of phosphate ester, phosphite esters, amine salts of phosphite ester, dithiophosphates (zinc dithiophosphate, molybdenum dithiophosphate, etc.), dithiocarbamates (molybdenum dithiocarbamate, etc.), chlorinated fats and oils may be used. In addition, various known rust inhibitors, antioxidants, corrosion inhibitors, etc. may be optionally added. Furthermore, in the lubricating oil composition for cutting and grinding, emulsifiers, sterilizers, etc. may be added when water is used.

In these cases, the amounts of oiliness agent and extreme pressure agent are not limited, but are usually added in amounts of 50 parts by weight or less, preferably 30 parts by weight or less based on 100 parts by the weight of the sum of the straight chain olefin and the base oil or water. The emulsifier may be added in an amount of 50 parts by weight or less, preferably 30 parts by weight or less, in the case of additives such as rust inhibitors, corrosion inhibitors or antifoamers, they may be each added in an amount of 30 parts by weight or less, preferably 10 parts by weight or less based on the same as the above.

As described above, the lubricating oil composition for plastic working in the present invention has excellent rolling characteristics such as lowering rolling load, increasing rolling reduction, and also gives the product a good surface finish after rolling. In particular, when it is employed for cold rolling various metals (aluminum, aluminum foil, steel (SUS304, SUS430), brass, etc.), the rolling characteristics can be improved and surface is so good that productivity and product quality can be remarkably improved.

Furthermore, when it is used as a lubricating oil composition for drawing, blanking, dieing out, cold forging, etc. various metals (aluminum alloys, pure titanium, titanium alloys, steel, etc.), there are advantages such as longer tool life or improved surface quality, as well as improved degreasing and rust preventive properties.

Accordingly, the lubricating oil composition for plastic working in the present invention can be widely and effectively utilized as a metal working fluid for plastic working such as rolling various metals and alloys.

Moreover, when cutting or grinding is carried out using the lubricating oil composition for cutting and grinding in the present invention, the surface detergence of the product can be remarkably improved, and further the surface of the material to be worked becomes good. Furthermore, wear resistance of working tools is remarkably improved so that a longer tool life can be achieved. Furthermore, it is not necessary to use a large amount of oiliness agents, extreme pressure agents, etc. and cutting and grinding can be carried out properly. Therefore, the lubricating oil composition for cutting and grinding in the present invention can be used extremely effectively for cutting and grinding various metals and alloys.

Next, the present invention is explained in more detail by referring to Examples and Comparative Examples. All "%" in the following Examples mean "% by weight".

(a) Rolling experiment (rolling of aluminum plate)

An aluminum plate of JIS A 3004 H16 (plate thickness of 1.2 mm, plate width of 60 mm, coil) was prepared as a rolling material, and this was rolled using a four-step roller having a work roll diameter of 135 mm under the conditions of rolling speed: 100 m/min, front tension: 150 kgf and back tension: 350 kgf with the use of the following lubricating oil composition for rolling. After rolling, surface state and rolling force to the plate thickness (rolling reduction) were measured. The rolling experiment was carried out only one pass, in which the rolling reduction was raised stepwise every 20-meter rollings, and observations concerning rolling force and surface state were made.

COMPARATIVE EXAMPLE 1 (a)

Rolling (a) was carried out using a lubricating oil composition for rolling composed of a paraffinic mineral oil having a kinematic viscosity of 4 cSt at 40° C. with 6% of lauryl alcohol and 1% of butylstearate added thereto as additives.

EXAMPLE 1 (a)

Rolling (a) was carried out using a lubricating oil composition for rolling in which 2% of the paraffinic mineral oil of Comparative Example 1 (a) was replaced with a mixture of 1-hexadecene and 1-octadecene (1:1).

EXAMPLE 2 (a)

Rolling (a) was carried out using a lubricating oil composition for rolling in which 20% of the paraffinic mineral oil of Comparative Example 1 (a) was replaced with a mixture of 1-hexadecene and 1-octadecene (1:1).

EXAMPLE 3 (a)

Rolling (a) was carried out using a lubricating oil composition for rolling in which 50% of the paraffinic mineral oil of Comparative Example 1 (a) was replaced with a mixture of 1-hexadecene and 1-octadecene (1:1).

EXAMPLE 4 (a)

Rolling (a) was carried out using a lubricating oil composition for rolling in which 70% of the paraffinic mineral oil of Comparative Example 1 (a) was replaced with a mixture of 1-hexadecene and 1-octadecene (1:1).

EXAMPLE 5 (a)

Rolling (a) was carried out by using a lubricating oil composition for rolling in which all of the paraffinic mineral oil of Comparative Example 1 (a) was replaced with a mixture of 1-hexadecene and 1-octadecene (1:1).

The results are summarized in Table 1.

(b) Rolling experiment (rolling of aluminum plate)

An aluminum plate of JIS A 5052 H16 (plate thickness of 1.2 mm, plate width of 60 mm, coil) was prepared as a rolling material, and this was rolled in the same manner as above (a) Rolling experiment except for changing the front tension to 170 kgf and the back tension to 400 kgf.

COMPARATIVE EXAMPLE 1 (b)

Rolling (b) was carried out using the lubricating oil composition Comparative Example 1 (a).

EXAMPLE 1 (b)

Rolling (b) was carried out using the lubricating oil composition of Example 1 (a).

EXAMPLE 2 (b)

Rolling (b) was carried out using the lubricating oil composition of Example 2 (a).

EXAMPLE 3 (b)

Rolling (b) was carried out using the lubricating oil composition of Example 3 (a).

EXAMPLE 4 (b)

Rolling (b) was carried out using the lubricating oil composition of Example 4 (a).

EXAMPLE 5 (b)

Rolling (b) was carried out using the lubricating oil composition of Example 5 (a).

The results are summarized in Table 2.

(c) Rolling experiment (rolling of aluminum plate)

An aluminum plate of JIS A 1100 0 (plate thickness of 1.0 mm, plate width of 60 mm, coil) was prepared as a rolling material, and this was subjected to rolling in the same manner as in above (a) Rolling experiment, except for changing the front tension to 90 kgf and the back tension to 150 kgf.

COMPARATIVE EXAMPLE 1 (c)

Rolling (c) was carried out using the lubricating oil composition of Comparative Example 1 (a).

EXAMPLE 1 (c)

Rolling (c) was carried out using the lubricating oil composition of Example 1 (a).

EXAMPLE 2 (c)

Rolling (c) was carried out using the lubricating oil composition of Example 2 (a).

EXAMPLE 3 (c)

Rolling (c) was carried out using the lubricating oil composition of Example 3 (a).

EXAMPLE 4 (c)

Rolling (c) was carried out using the lubricating oil composition of Example 4 (a).

EXAMPLE 5 (c)

Rolling (c) was carried out using the lubricating oil composition of Example 5 (a).

The results are summarized in Table 3.

TABLE 1

| Plate thickness after rolling (rolling reduction) | Comparative Example 1 (a) | | Example 1 (a) | | Example 2 (a) | | Example 3 (a) | | Example 4 (a) | | Example 5 (a) | |
|---|---|---|---|---|---|---|---|---|---|---|---|---|
| | Surface state | Rolling force (t) | Surface state | Rolling force (t) | Surface state | Rolling force (t) | Surface state | Rolling force (t) | Surface state | Rolling force (t) | Surface state | Rolling force (t) |
| 0.55 mm (54.2%) | ○ | 11.0 | ○ | 10.9 | ○ | 10.8 | ○ | 10.7 | ○ | 10.6 | ○ | 10.6 |
| 0.50 mm (58.3%) | ○ | 12.8 | ○ | 12.6 | ○ | 11.2 | ○ | 10.9 | ○ | 10.8 | ○ | 10.8 |
| 0.47 mm (60.8%) | ○ | 13.1 | ○ | 12.9 | ○ | 12.0 | ○ | 11.6 | ○ | 11.0 | ○ | 10.8 |
| 0.44 mm (63.3%) | ○ | 14.0 | ○ | 13.8 | ○ | 12.3 | ○ | 11.9 | ○ | 11.2 | ○ | 10.7 |
| 0.41 mm (65.8%) | ○ | 15.1 | ○ | 14.5 | ○ | 13.0 | ○ | 12.1 | ○ | 11.3 | ○ | 10.7 |
| 0.38 mm (68.3%) | X | 17.0 | ○ | 16.3 | ○ | 13.5 | ○ | 12.2 | ○ | 11.2 | ○ | 10.5 |
| 0.35 mm (70.8%) | — | — | X | 18.5 | ○ | 14.5 | ○ | 12.3 | ○ | 11.2 | ○ | 10.3 |
| 0.32 mm (73.3%) | — | — | — | — | X | 16.8 | ○ | 12.5 | ○ | 11.0 | ○ | 10.2 |
| 0.29 mm (75.8%) | — | — | — | — | — | — | ○ | 12.8 | Δ | 11.0 | Δ | 9.8 |

Surface state . . . ○: Normal, Δ: Cracking generated at edge portion, X: herring bone generated.

TABLE 2

| Plate thickness after rolling (rolling reduction) | Comparative Example 1 (b) | | Example 1 (b) | | Example 2 (b) | | Example 3 (b) | | Example 4 (b) | | Example 5 (b) | |
|---|---|---|---|---|---|---|---|---|---|---|---|---|
| | Surface state | Rolling force (t) | Surface state | Rolling force (t) | Surface state | Rolling force (t) | Surface state | Rolling force (t) | Surface state | Rolling force (t) | Surface state | Rolling force (t) |
| 0.60 mm (54.2%) | ○ | 12.0 | ○ | 12.0 | ○ | 11.6 | ○ | 11.5 | ○ | 11.5 | ○ | 11.5 |
| 0.55 mm (54.2%) | ○ | 13.2 | ○ | 13.0 | ○ | 11.8 | ○ | 11.7 | ○ | 11.7 | ○ | 11.7 |
| 0.50 mm (58.3%) | ○ | 14.5 | ○ | 14.2 | ○ | 12.0 | ○ | 12.0 | ○ | 12.0 | ○ | 12.0 |
| 0.47 mm (60.8%) | X | 16.1 | ○ | 15.5 | ○ | 12.5 | ○ | 12.4 | ○ | 12.3 | ○ | 12.3 |
| 0.44 mm (63.3%) | — | — | X | 16.5 | ○ | 13.1 | ○ | 13.1 | ○ | 13.1 | ○ | 13.1 |
| 0.41 mm (65.8%) | — | — | — | — | ○ | 13.5 | ○ | 13.3 | ○ | 13.2 | ○ | 13.2 |
| 0.38 mm (68.3%) | — | — | — | — | ○ | 14.1 | ○ | 14.0 | ○ | 13.5 | ○ | 13.5 |
| 0.35 mm (70.8%) | — | — | — | — | X | 16.7 | ○ | 14.7 | ○ | 14.0 | ○ | 14.0 |
| 0.32 mm (73.3%) | — | — | — | — | — | — | ○ | 15.3 | ○ | 14.6 | Δ | 14.6 |
| 0.29 mm (75.8%) | — | — | — | — | — | — | ○ | 16.0 | Δ | 15.0 | Δ | 15.0 |

Surface state . . . ○: Normal, Δ: Cracking generated at edge portion, X: herring bone generated.

TABLE 3

| Plate thickness after rolling (rolling reduction) | Comparative Example 1 (c) | | Example 1 (c) | | Example 2 (c) | | Example 3 (c) | | Example 4 (c) | | Example 5 (c) | |
|---|---|---|---|---|---|---|---|---|---|---|---|---|
| | Surface state | Rolling force (t) | Surface state | Rolling force (t) | Surface state | Rolling force (t) | Surface state | Rolling force (t) | Surface state | Rolling force (t) | Surface state | Rolling force (t) |
| 0.50 mm (50.0%) | ○ | 5.5 | ○ | 5.5 | ○ | 5.5 | ○ | 5.5 | ○ | 5.9 | ○ | 5.4 |
| 0.45 mm (55.0%) | ○ | 5.9 | ○ | 5.9 | ○ | 5.9 | ○ | 5.8 | ○ | 5.8 | ○ | 5.8 |
| 0.40 mm (60.0%) | ○ | 6.3 | ○ | 6.3 | ○ | 6.2 | ○ | 6.2 | ○ | 6.2 | ○ | 6.2 |
| 0.37 mm (63.0%) | ○ | 6.6 | ○ | 6.6 | ○ | 6.5 | ○ | 6.2 | ○ | 6.2 | ○ | 6.2 |
| 0.34 mm (66.0%) | ○ | 7.0 | ○ | 6.9 | ○ | 6.7 | ○ | 6.3 | ○ | 6.2 | ○ | 6.1 |
| 0.31 mm (69.0%) | ○ | 7.2 | ○ | 7.2 | ○ | 7.0 | ○ | 6.5 | ○ | 6.1 | ○ | 6.0 |
| 0.28 mm (72.0%) | X | 7.8 | ○ | 7.6 | ○ | 7.4 | ○ | 6.6 | ○ | 6.1 | ○ | 6.9 |
| 0.25 mm (75.0%) | X | 8.6 | X | 8.4 | ○ | 7.7 | ○ | 7.0 | ○ | 6.0 | ○ | 6.9 |
| 0.22 mm (78.0%) | X | 9.0 | X | 8.8 | ○ | 8.1 | ○ | 7.1 | ○ | 5.9 | ○ | 6.8 |
| 0.20 mm (80.0%) | X | 9.5 | X | 9.3 | ○ | 8.4 | ○ | 7.0 | ○ | 5.9 | X | 6.8 |

Surface state . . . ○: Normal, Δ: Cracking generated at edge portion, X: herring bone generated Rolling experiment (rolling aluminum foil)

Pure aluminum foil H18 (foil thickness of 0.09 mm, foil width of 60 mm, coil) was prepared as a rolling material and this was rolled using a four-step roller having a work roll diameter of 40 mm and a roll crown of 0.02 mm under the conditions of rolling speed: 100 m/min, front tension: 5 kgf and back tension: 15 kgf with the use of the following lubricating oil composition for rolling. After rolling, foil thickness and surface state to rolling force were measured. The rolling experiment was carried out only one pass, in which the rolling reduction was raised stepwise every 100-meter rolling, and observations concerning rolling force and surface state were made.

COMPARATIVE EXAMPLE 2

Rolling was carried out using a lubricating oil composition for rolling composed of a paraffinic mineral oil having a kinematic viscosity of 3.5 cSt at 40° C. with 2% of lauryl alcohol and 1% of butylstearate added thereto as additives.

EXAMPLE 6

Rolling was carried out using a lubricating oil composition for rolling in which 50% of the paraffinic mineral oil of Comparative Example 2 was replaced with a mixture of 1-dodecene and 1-tetradecene (1:1).

The results are summarized in Table 4.

TABLE 4

| Rolling force (t) | Example 6 Foil thickness | Example 6 Herring bone | Comparative Example 2 Foil thickness | Comparative Example 2 Herring bone |
|---|---|---|---|---|
| 2 | 35 μm | None | 40 μm | None |
| 3 | 28 μm | None | 31 μm | Present |
| 5 | 22 μm | None | 25 μm | Present |
| 8 | 19 μm | None | 22 μm | Present |
| 10 | 17 μm | None | 22 μm | Present |

Rolling experiment with stainless steel plate

A stainless steel plate of SUS 304 2D (plate thickness of 1.5 mm, plate width of 50 mm, coil) was prepared as a rolling material and this was rolled for 3 passes using a four-step roller having a work roll diameter of 40 mm under the conditions of rolling speed: 100 m/min, front and back tensions: 1000 kgf with the use of the following lubricating oil composition for rolling. Then, rolling for the fourth pass was carried out with front and back tensions of 750 kgf. Rolling force and surface state were observed upon changing the rolling reduction at the fourth pass.

COMPARATIVE EXAMPLE 3

Rolling was carried out using a lubricating oil composition for rolling composed of a paraffinic mineral oil having a kinematic viscosity of 8 cSt at 40° C. with 15% of butylstearate added thereto as an additive.

EXAMPLE 7

Rolling was carried out using a lubricating oil composition for rolling in which 50% of a paraffinic mineral oil of the above Comparative EXAMPLE 3 was replaced with a mixture of n-α-olefin having 20 to 28 carbon atoms.

The results are summarized in Table 5.

TABLE 5

| Passed time | Plate thickness after rolling (Rolling reduction) | Example 7 Rolling force | Example 7 Heat scratch | Comparative Example 3 Rolling force | Comparative Example 3 Heat scratch |
|---|---|---|---|---|---|
| 1 | 1.20 mm (20.0%) | 13.0 t | None | 13.2 t | None |
| 2 | 0.98 mm (18.3%) | 14.9 t | None | 15.2 t | None |
| 3 | 0.80 mm (18.4%) | 16.0 t | None | 16.4 t | None |
| 4 | 0.57 mm (28.7%) | 16.8 t | None | 17.6 t | None |
| | 0.55 mm (28.7%) | 17.5 t | None | 18.5 t | None |
| | 0.53 mm (33.7%) | 17.9 t | None | 18.8 t | None |
| | 0.51 mm (36.2%) | 18.5 t | None | 19.3 t | Present |

Rolling experiment with brass plate

A brass plate of JIS C 2680 R ¼ H (plate thickness of 1.0 mm, plate width of 50 mm) was prepared as a rolling material and this was rolled using a two-step roller having a work roll diameter of 200 mm under the conditions of rolling speed: 100 m/min, and changing front and back tensions at each pass with the use of the following lubricating oil composition for rolling. Rolling force was observed at that time.

COMPARATIVE EXAMPLE 4

Rolling was carried out using a lubricating oil composition for rolling composed of a paraffinic mineral oil having a kinematic viscosity of 4 cSt at 40° C. with 5% of butylstearate added thereto as an additive.

EXAMPLE 8

Rolling was carried out using a lubricating oil composition for rolling in which 50% of the paraffinic mineral oil of Comparative Example 4 was replaced with a mixture of 1-hexadecene and 1-octadecene (1:1).

The results are summarized in Table 6.

TABLE 6

| Passed times | Front tension | Back tension | Plate thickness after rolling | Example 8 Rolling force | Comparative Example 4 Rolling force |
|---|---|---|---|---|---|
| 1 | 300 kgf | 300 kgf | 0.603 mm | 16.8 t | 17.0 t |
| 2 | 220 kgf | 300 kgf | 0.435 mm | 20.8 t | 21.2 t |
| 3 | 160 kgf | 220 kgf | 0.328 mm | 21.5 t | 22.3 t |
| 4 | 130 kgf | 160 kgf | 0.254 mm | 19.7 t | 20.5 t |
| 5 | 100 kgf | 130 kgf | 0.200 mm | 20.5 t | 22.0 t |

(a) Drawing experiment

An aluminum alloy of A-2024 (plate thickness of 1.5 mm, plate width of 30 mm) was prepared as the material to be worked, and was drawn using a die made of SKS 3 and a shape (shoulder radius) of 3 mm under the conditions of die pressing force: 200 to 800 kg and a drawing speed of 50 mm/min for the drawing work experiment with the use of the following lubricating oil composition for drawing. Drawing force and surface state were observed at that time.

COMPARATIVE EXAMPLE 5 (a)

The drawing experiment (a) was carried out using a lubricating oil composition for drawing composed of 85% of a paraffinic mineral oil having a kinematic viscosity of 4 cSt at 40° C. and 15% of an ester added thereto.

EXAMPLE 9 (a)

The drawing experiment (a) was carried out using a lubricating oil composition for drawing in which half the amount of the paraffinic mineral oil of Comparative Example 5 (a) was replaced with a mixture of 1-hexadecene and 1-octadecene (1:1).

The results are summarized in Table 7.

(b) Drawing experiment

Pure titanium of JIS 2 kind (plate thickness of 0.6 mm, plate width of 40 mm) was prepared as a material to be worked and this was subjected to the drawing experiment with the same conditions as in the above drawing experiment (a) with the us of the following lubricating oil composition for drawing, and drawing force and surface state at that time were observed.

COMPARATIVE EXAMPLE 5 (b)

The drawing experiment (b) was carried out by using a lubricating oil composition for drawing composed of 85% paraffinic mineral oil having a kinematic viscosity of 4 cSt at 40° C. and 15% of an ester added thereto.

EXAMPLE 9 (b)

The drawing experiment (b) was carried out using a lubricating oil composition for drawing in which half the amount of the paraffinic mineral oil of Comparative Example 5 (b) was replaced with a mixture of 1-hexadecene and 1-octadecene (1:1).

The results are summarized in Table 8.

TABLE 7

| No. | Die pressing force (kg) | Maximum drawing force (kg) | Average drawing force (kg) | Surface state |
|---|---|---|---|---|
| Example 9 (a) | 400 | 210 | 195 | Normal |
| | 600 | 360 | 325 | Normal |
| | 800 | 500 | 415 | |
| Comparative Example 5 (a) | 400 | 255 | 220 | Normal |
| | 600 | 380 | 350 | Normal |
| | 800 | 605 | 520 | Dragging (slight) |

TABLE 8

| No. | Die pressing force (kg) | Maximum drawing force (kg) | Average drawing force (kg) | Surface state |
|---|---|---|---|---|
| Example 9 (b) | 200 | 330 | 290 | Normal |
| | 300 | 410 | 385 | Normal |
| | 400 | 520 | 495 | Dragging (slight) |
| Comparative Example 5 (b) | 200 | 370 | 355 | Normal |
| | 300 | 455 | 440 | Dragging (moderate) |
| | 400 | 585 | 560 | Dragging (serious) |

Blanking experiment

An aluminum plate of JIS A 1100-H26 (plate thickness of 0.10 mm) was prepared to be worked. Using a 50 ton-press (produced by Burr Oak Co.) exclusively for aluminum fin molding, a blanking experiment was carried out under the conditions of tool material of high speed steel, stroke speed of 0.5 m/sec, thickness reduction of 55%, molding hole shape of 2.5/8 inches and working time of 300 cycle/min × 5 min with the use of the following lubricating oil composition for blanking.

EXAMPLE 10

The blanking experiment was carried out using a lubricating oil composition for blanking composed of 95% of a paraffinic mineral oil having a kinematic viscosity of 4 cSt at 40° C. and 5% of a mixture of 1-hexadecene and 1-octadecene (1:1).

EXAMPLE 11

The blanking experiment was carried out using a lubricating oil composition for blanking composed of 90% of a paraffinic mineral oil having a kinematic viscosity of 4 cSt at 40° C. and 10% of a mixture of 1-hexadecene and 1-octadecene (1:1).

EXAMPLE 12

The blanking experiment was carried out using lubricating oil composition for blanking composed of 80% of a paraffinic mineral oil having a kinematic viscosity of 4 cSt 40° C. and 20% of a mixture of 1-hexadecene and 1-octadecene (1:1).

EXAMPLE 13

The blanking experiment was carried out using a lubricating oil composition for blanking composed of 50% of a paraffinic mineral oil having a kinematic viscosity of 4 cSt at 40° C. and 50% of a mixture of 1-hexadecene and 1-octadecene (1:1).

EXAMPLE 14

The blanking experiment was carried out using a lubricating oil composition for blanking composed of 20% of a paraffinic mineral oil having a kinematic viscosity of 4 cSt at 40° C. and 80% of a mixture of 1-hexadecene and 1-octadecene (1:1).

EXAMPLE 15

The blanking experiment was carried out using only a mixture of 1-hexadecene and 1-octadecene (1:1) as a lubricating oil composition for blanking.

EXAMPLE 16

The blanking experiment was carried out using a lubricating oil composition for blanking composed of 20% of a mixture of 1-hexadecene and 1-octadecene (1:1) and 80% of a polybutene (molecular weight: 265).

COMPARATIVE EXAMPLE 6

The blanking experiment was carried out using only a paraffinic mineral oil having a kinematic viscosity of 4 cSt at 40° C. as a lubricating oil composition for blanking.

COMPARATIVE EXAMPLE 7

The blanking experiment was carried out by using a lubricating oil composition for blanking composed of 90% of a paraffinic mineral oil having a kinematic viscosity of 4 cSt at 40° C. and 10% of butylstearate.

The result are summarized in Table 9.

TABLE 9

| No. | Thickness*1 reduction | Tool abrasion*2 | Odor*3 |
|---|---|---|---|
| Example 10 | 20 | None | |
| Example 11 | 9 | None | |
| Example 12 | 5 | None | |
| Example 13 | 0 | None | |
| Example 14 | 5 | Minute amount present | |
| Example 15 | 12 | Present | |
| Example 16 | 2 | None | |
| Comparative Example 6 | 58 | None (Cohesion present) | |
| Comparative Example 7 | 28 | None | |

*1Thickness reduction is shown by defective ratio (%).
*2Abrasion at punch ironing portion is shown.
*3Sensitive test by 5 panelists 3m from a press portion was carried out and judged as shown below.
◎ No members notice malodor.
○ One panelist noticed malodor.
Δ Three or more panelists noticed malodor.

EXAMPLES 17 TO 27 AND COMPARATIVE EXAMPLES 8 AND 9

Using the lubricating oil compositions for cutting and grinding shown in Table 10, evaluations regarding the surface roughness of a material to be worked, wear resistance of a tool and surface detergency of an aluminum plate were carried out for drilling work. The results are shown in Table 10.

(1) Evaluation methods for surface roughness and wear resistance

Using an aluminum-silicon alloy casting (JIS AC8A), an air feed drill as a working machine and HSS twist drill (inner diameter: 3.3 mm) as a drill, drilling was carried out to a depth of 20 mm and a lubricating oil composition was supplied at 1.0 liter/min.

Surface roughness ($R_{max}$) was measured after working 10 materials and was evaluated as an index of surface finishing.

Wear resistance was evaluated as maximum wear width or depth ($\mu$) at a drill margin portion after working of 200 materials to be worked as an index.

(2) Evaluating method of surface detergency

On the surface of a mirror-finished aluminum plate (50 mm×50 mm), one drop (about 0.02 ml) of a lubricating oil composition was dropped and allowed to stand at 60° C. for 3 hours in a thermostat; then the surface was observed and evaluated by the following standards.

| Evaluation | |
|---|---|
| No cloud (oil stain) with mirrored surface | A |
| Extremely minor cloud (oil stain) with mirrored surface | B |
| Slight cloud (oil stain) with mirrored surface | C |
| Remarkable cloud (oil stain) with mirrored surface | D |

TABLE 10

| No. | Composition: Straight chain olefin | % by weight | Base oil | % by weight | Additives | Parts*6 by weight | roughness ($\mu$) | Surface resistance ($\mu$) | Wear Surface detergency |
|---|---|---|---|---|---|---|---|---|---|
| Example 17 | Olefin I*1 | 100 | — | 0 | — | 0 | 8 | 440 | A |
| Example 18 | Olefin I*1 | 100 | — | 0 | Oiliness, extreme*5 pressure agents | 10 | 7 | 400 | B |
| Example 19 | Olefin I*1 | 50 | Mineral oil*3 | 50 | Oiliness, extreme pressure agents | 10 | 6 | 340 | C |
| Example 20 | Olefin I*1 | 20 | Mineral oil*3 | 80 | Oiliness, extreme*5 pressure agents | 10 | 7 | 310 | C |
| Example 21 | Olefin I*1 | 5 | Mineral oil*3 | 95 | Oiliness, extreme*5 pressure agents | 10 | 8 | 300 | C |
| Example 22 | Olefin II*2 | 50 | Synthetic*4 oil | 50 | Oiliness, extreme*5 pressure agents | 10 | 6 | 350 | B |
| Example 23 | Olefin II*2 | 20 | Synthetic*4 oil | 80 | Oiliness, extreme*5 pressure agents | 10 | 6 | 325 | B |
| Example 24 | Olefin II*2 | 5 | Synthetic*4 oil | 95 | Oiliness, extreme*5 pressure agents | 10 | 7 | 300 | B |
| Example 25 | Olefin II*2 | 50 | Synthetic*4 oil | 50 | — | 0 | 9 | 260 | A |
| Example 26 | Olefin II*2 | 50 | Mineral oil*3 | 50 | — | 0 | 9 | 200 | B |
| Example 27 | Olefin II*2 | 50 | Synthetic*4 oil | 50 | Oiliness, extreme*5 pressure agents | 1 | 6 | 230 | A |
| Comparative Example 8 | — | — | Mineral oil*3 | 100 | — | 0 | 64 | Drill*7 rupture | D |
| Comparative Example 9 | — | — | Mineral oil*3 | 100 | Oiliness, extreme*5 pressure agents | 10 | 12 | 480 | D |

*1Equal mixture of 1-hexadecene and 1-octadecene
*2Equal mixture of 1-dodecene and 1-tetradecane
*3Paraffin type mineral oil (kinematic viscosity at 40° C. of 8 cSt)
*4Light weight polybutene (kinematic viscosity at 40° C. of 1.2 cSt)
*5Mixture of chlorinated paraffin and fats and oils (1:1)
*6Formulating amount based on 100 parts by weight of sum of straight chain olefin and base oil is shown.
*7Drill ruptured at the 105th specimen.

What is claimed is:

1. A lubricating oil composition for plastic working of metals comprising 0.5 to 99.5% by weight of at least one straight chain olefin having 6 to 40 carbon atoms and at least one of water and a base oil having a kinematic viscosity at 40° C. of 0.5 to 500 cSt and comprising at least one synthetic oil selected from the group consisting of polybutene, polypropylene and a hydrogenated material of polybutene or polypropylene.

2. A lubricating oil composition for plastic working according to claim 1, wherein the at least one straight chain olefin is a straight chain-$\alpha$-olefin having 8 to 30 carbon atoms.

3. A lubricating oil composition for plastic working according to claim 2, wherein the composition contains 2 to 50% by weight of the at least one straight chain olefin.

4. A lubricating oil composition for cutting and grinding of metals comprising 0.5 to 80% by weight of at least one straight chain olefin having 6 to 40 carbon atoms and at least one of water and a base oil have a kinematic viscosity at 40° C. of 0.5 to 500 cSt and comprising at least one synthetic oil selected from the group consisting of polybutene, polypropylene and a hydrogenated material of polybutene or polypropylene.

5. A lubricating oil composition for cutting and grinding according to claim 4, wherein the at least one straight chain olefin is a straight chain-$\alpha$-olefin having 8 to 30 carbon atoms.

6. A lubricating oil composition for plastic working according to claim 4, wherein the polybutene and the polypropylene are low molecular weight oligomers.

* * * * *